US007798794B2

(12) United States Patent
Izawa et al.

(10) Patent No.: US 7,798,794 B2
(45) Date of Patent: Sep. 21, 2010

(54) SCREW PUMP AND SCREW ROTOR

(75) Inventors: Yuya Izawa, Kariya (JP); Shinya Yamamoto, Kariya (JP); Masahiro Inagaki, Kariya (JP); Makoto Yoshikawa, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 66 days.

(21) Appl. No.: 11/992,700

(22) PCT Filed: Sep. 3, 2007

(86) PCT No.: PCT/JP2007/067125

§ 371 (c)(1),
(2), (4) Date: Mar. 26, 2008

(87) PCT Pub. No.: WO2008/029759

PCT Pub. Date: Mar. 13, 2008

(65) Prior Publication Data

US 2010/0178191 A1 Jul. 15, 2010

(30) Foreign Application Priority Data

Sep. 5, 2006 (JP) ..... 2006-240042

(51) Int. Cl.
*F04C 18/00* (2006.01)
*F04C 2/00* (2006.01)

(52) U.S. Cl. ..... 418/201.3; 418/201.1

(58) Field of Classification Search ..... 418/201.3, 418/201.1, 206.5, 206.1
See application file for complete search history.

(56) References Cited

U.S. PATENT DOCUMENTS 2,994,562 A * 8/1961 Zalis ..... 418/201.1

(Continued)

FOREIGN PATENT DOCUMENTS

GB 112104 * 12/1917

(Continued)

OTHER PUBLICATIONS

International Preliminary Report on Patentability issued on Mar. 17, 2009, for the corresponding PCT Application No. PCT/2007/067125.

(Continued)

*Primary Examiner*—Theresa Trieu
(74) *Attorney, Agent, or Firm*—Locke Lord Bissell & Liddell LLP

(57) ABSTRACT

A cross section of a tooth profile of a first screw rotor (17) perpendicular to the rotor axis includes a tooth top arc (A1B1), a tooth bottom arc (C1D1), a first curve (A1C1), and a second curve (B1D1). The first curve (A1C1) is a first trochoidal curve that connects a first end (A1) of the tooth top arc (A1B1) to a second end (C1) of the tooth bottom arc (C1D1). The second curve (B1D1) connects the second end (B1) of the tooth top arc (A1B1) to the first end (D1) of the tooth bottom arc (C1D1). The second curve (B1D1) is a composite curve formed by an involute curve (B1E1) and a second trochoidal curve (E1D1), which extend continuously from each other at a first intersection point (E1). A screw pump (11) thus suppresses leakage of fluid with improved performance.

3 Claims, 8 Drawing Sheets

U.S. PATENT DOCUMENTS

| | | | | | |
|---|---|---|---|---|---|
| 4,792,294 | A | * | 12/1988 | Mowli | 418/201.1 |
| 5,667,370 | A | * | 9/1997 | Im | 418/201.1 |
| 5,697,772 | A | | 12/1997 | Kawamura et al. | 418/201.3 |
| 5,800,151 | A | | 9/1998 | Kawamura et al. | 418/201.3 |
| 6,368,091 | B1 | * | 4/2002 | Mito | 418/201.3 |
| 6,447,276 | B1 | * | 9/2002 | Becher | 418/201.3 |
| 7,625,191 | B2 | * | 12/2009 | Goepfert | 418/201.3 |

FOREIGN PATENT DOCUMENTS

| | | |
|---|---|---|
| JP | 57-46083 | 3/1982 |
| JP | 8-277790 | 10/1996 |
| JP | 2005-351238 | 12/2005 |
| WO | 2005/113984 | 12/2005 |

OTHER PUBLICATIONS

PCT International Search Report (PCT/JP2007/067125) mailed Oct. 2, 2007.

* cited by examiner

SCREW PUMP AND SCREW ROTOR

This application is the national phase under 35 U.S.C. §371 of PCT International Application No. PCT/JP2007/067125 which has an International filing date of Sep. 3, 2007, which designated the United States of America.

FIELD OF THE INVENTION

The present invention relates to a screw pump that draws fluid into a housing and discharges the fluid to the exterior of the housing by rotating a pair of screw rotors. The present invention further relates to screw rotors in a screw pump.

BACKGROUND OF THE INVENTION

Patent Document 1 discloses a screw pump that has a pair of screw rotors engaged with each other. As the screw rotors rotate, the screw pump operates to transport fluid.

As shown in FIG. 11, a cross section of the tooth profile of a first conventional screw rotor 90A perpendicular to the rotor axis is shaped and sized equally with that of a second conventional screw rotor 90B. The cross section of the tooth profile of the first conventional screw rotor 90A perpendicular to the rotor axis is to the shape of the tooth profile of the first conventional screw rotor 90A on an imaginary plane extending perpendicular to the rotary axis of the first conventional screw rotor 90A. The cross section of the tooth profile of the first conventional screw rotor 90A perpendicular to the rotor axis includes a tooth top arc Q1R1, a tooth bottom arc S1T1, a first curve S1Q1, and a second curve T1R1. The first curve S1Q1 connects a first end S1 of the tooth bottom arc S1T1 to a first end Q1 of the tooth top arc Q1R1. The second curve T1R1 connects a second end T1 of the tooth bottom arc S1T1 to a second end R1 of the tooth top arc Q1R1.

The cross section of the tooth profile of the second conventional screw rotor 90B perpendicular to the rotor axis includes a tooth top arc Q2R2, a tooth bottom arc S2T2, a first curve S2Q2, and a second curve T2R2. The first curve S2Q2 connects a first end S2 of the tooth bottom arc S2T2 to a first end Q2 of the tooth top arc Q2R2. The second curve T2R2 connects a second end T2 of the tooth bottom arc S2T2 to a second end R2 of the tooth top arc Q2R2.

The first curve S1Q1 of the first conventional screw rotor 90A includes a trochoidal curve U1S1 and a connecting portion Q1U1. The trochoidal curve U1S1 is created by the path of the first end Q2 of the tooth top arc Q2R2 when the second conventional screw rotor 90B revolves about the first conventional screw rotor 90A. The connecting portion Q1U1 is a straight line that connects an end U1 of the trochoidal curve U1S1 to the first end Q1 of the tooth top arc Q1R1. The second curve T1R1 includes an outer circular arc R1W1, an involute curve W1Y1, and an inner circular arc Y1T1. The involute curve W1Y1 is located between the outer circular arc R1W1 and the inner circular arc Y1T1. The outer circular arc R1W1 is connected to the tooth top arc Q1R1 and the inner circular arc Y1T1 is connected to the tooth bottom arc S1T1.

Similarly, the first curve S2Q2 of the second conventional screw rotor 90B includes a trochoidal curve U2S2 and a connecting portion Q2U2, which is a straight line. The second curve T2R2 includes an outer circular arc R2W2, an involute curve W2Y2, and an inner circular arc Y2T2.

Neither the first conventional screw rotor 90A nor the second conventional screw rotor 90B contacts the housing of the screw pump. Further, the first conventional screw rotor 90A and the second conventional screw rotor 90B do not contact each other. Such arrangement thus may potentially cause leakage of the fluid (leakage of gas). Although the tooth profiles of the first and second conventional screw rotors 90A, 90B are shaped in such a manner as to suppress the fluid leakage, the fluid leakage is desired to be suppressed further effectively.

Patent Document 1: Japanese Laid-Open Patent Publication No. 2005-351238

SUMMARY OF THE INVENTION

Accordingly, it is an objective of the present invention to provide a screw pump and a screw rotor that reliably suppress leakage of fluid.

In order to achieve the foregoing objective and in accordance with one aspect of the present invention, a screw pump including a housing, and a first screw rotor and a second screw rotor received in the housing is provided. The first screw rotor and the second screw rotor rotate in a direction in which the first and second screw rotors become engaged with each other. A fluid is drawn into the housing and then discharged to the exterior through rotation of the first screw rotor and the second screw rotor. A cross section of a tooth profile of the first screw rotor and a cross section of a tooth profile of the second screw rotor perpendicular to the respective rotor axes each include a first circular arc portion, a second circular arc portion, a first curved portion, and a second curved portion. The first circular arc portion and the second circular arc portion each have a first end and a second end. The radius of curvature of the second circular arc portion is smaller than the radius of curvature of the first circular arc portion. The first curved portion connects the first end of the first circular arc portion to the first end of the second circular arc portion. The second curved portion connects the second end of the first circular arc portion to the second end of the second circular arc portion. The first curved portion of the first screw rotor is a first trochoidal curve created by the first end of the first circular arc portion of the second screw rotor. The second curved portion of the first screw rotor includes an involute curve and a second trochoidal curve that extend continuously from each other. The involute curve extends continuously from the second end of the first circular arc portion of the first screw rotor. The second trochoidal curve is created by the second end of the first circular arc portion of the second screw rotor. The first curved portion of the second screw rotor is a first trochoidal curve created by the first end of the first circular arc portion of the first screw rotor. The second curved portion of the second screw rotor includes an involute curve and a second trochoidal curve that extend continuously from each other. The involute curve extends continuously from the second end of the first circular arc portion of the second screw rotor. The second trochoidal curve is created by the second end of the first circular arc portion of the first screw rotor.

The rotary axis of the first screw rotor can be referred to as a first axis, and the rotary axis of the second screw rotor can be referred to as a second axis. The angle of the first circular arc portion of the first screw rotor with respect to the first axis, the angle of the second circular arc portion of the first screw rotor with respect to the first axis, the angle of the first circular arc portion of the second screw rotor with respect to the second axis, and the angle of the second circular arc portion of the second screw rotor with respect to the second axis can all be set equal.

In accordance with another aspect of the present invention, a screw rotor of a screw pump is provided. The screw rotor is one of a first screw rotor and a second screw rotor.

The term "a cross section of the tooth profile of a first screw rotor perpendicular to the rotor axis" refers to a cross-sectional shape of the tooth profile of the first screw rotor on an imaginary plane extending perpendicular to the rotary axis of the first screw rotor. The term "a cross section of a second screw rotor perpendicular to the rotor axis" refers to a cross-sectional shape of the tooth profile of the second screw rotor on an imaginary plane extending perpendicular to the rotary axis of the second screw rotor. The tooth profile according to the present invention increases the axial dimension (the dimension along the rotary axis) of a tooth top surface. The tooth top surface is a circumferential surface formed by a first circular arc portion. A tooth bottom surface is a circumferential surface formed by the second circular arc portion. The increased axial dimension of the tooth top surface decreases the amount of the fluid leaking from between a housing and the tooth top surface.

BRIEF DESCRIPTION OF THE DRAWINGS

FIG. 2(*b*) is a cross-sectional view showing a first screw rotor and a second screw rotor in a state rotated by 180° from the state in FIG. 2(*a*);

FIG. 2(*c*) is an enlarged view showing a portion of FIG. 1;

FIG. 8(*b*) is an enlarged view showing the second curved portions that are engaged with each other;

FIGS. 9(*d*), 9(*e*), and 9(*f*) are cross-sectional views showing comparative examples of a tooth profile of a first conventional screw rotor and a tooth profile of a second conventional screw rotor, as viewed perpendicularly to the axes of the rotors;

FIG. 10(*b*) is a cross-sectional view showing a portion of FIG. 10(*a*)

DETAILED DESCRIPTION OF THE PREFERRED EMBODIMENTS

FIGS. 1 to 9 illustrate a first embodiment of the present invention.

Figure 1:
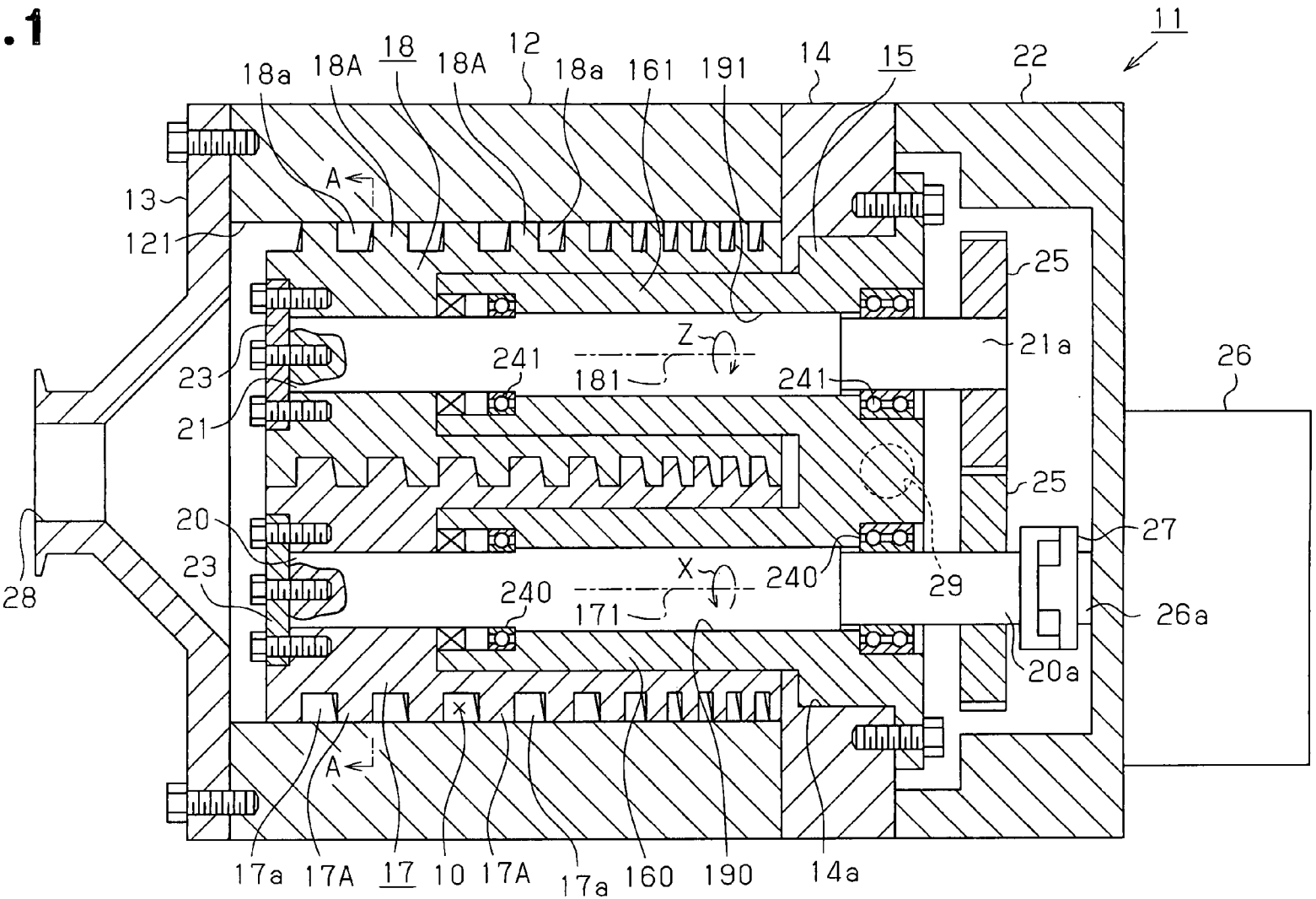
FIG. 1 is a cross-sectional plan view showing a screw pump according to a first embodiment of the present invention.

FIG. 1 shows a screw pump 11 according to the first embodiment. The screw pump 11 operates to transport gas, which is fluid. As shown in FIG. 1, the housing of the screw pump 11 includes a rotor housing member 12, a front housing member 13, and a rear housing member 14. The front housing member 13 shaped like a lid is joined with the front end (left end as viewed in the drawing) of the rotor housing member 12 with a cylindrical shape. The rear housing member 14 shaped like a plate is joined with the rear end (right end as viewed in the drawing) of the rotor housing member 12. The rear housing member 14 has a stepped securing hole 14*a*. A shaft receiving body 15 is passed through the securing hole 14*a* and fastened to the rear housing member 14 using a bolt. The shaft receiving body 15 has a first cylindrical portion 160 and a second cylindrical portion 161, which extend parallel with each other in a forward direction. The first and second cylindrical portions 160, 161 are each arranged in the rotor housing member 12.

The first cylindrical portion 160 has a first support hole 190 and the second cylindrical portion 161 has a second support hole 191. The first support hole 190 and the second support hole 191 each extend through the shaft receiving body 15. A drive shaft 20 is received in the first support hole 190 and a driven shaft 21 is arranged in the second support hole 191. A pair of first roller bearings 240 support the drive shaft 20 in a manner rotatable with respect to the shaft receiving body 15. A pair of second roller bearings 241 support the driven shaft 21 in a manner rotatable with respect to the shaft receiving body 15. The axis of the first cylindrical portion 160 coincides with a first axis 171, which is the rotary axis of the drive shaft 20. The axis of the second cylindrical portion 161 coincides with a second axis 181, which is the rotary axis of the driven shaft 21. The front end of the drive shaft 20 and the front end of the driven shaft 21 (left end as viewed in FIG. 1) project from the first support hole 190 and the second support hole 191, respectively.

The rotor housing member 12 accommodates a first screw rotor 17 and a second screw rotor 18. The front end (left end as viewed in FIG. 1) of the first screw rotor 17 is fixed to the front end of the drive shaft 20 through a joint plate 23 using a bolt. The front end of the second screw rotor 18 is fixed to the front end of the driven shaft 21 through another joint plate 23 using a bolt. Thus, the first screw rotor 17 rotates integrally with the drive shaft 20 and the second screw rotor 18 rotates integrally with the driven shaft 21.

Figure 2:
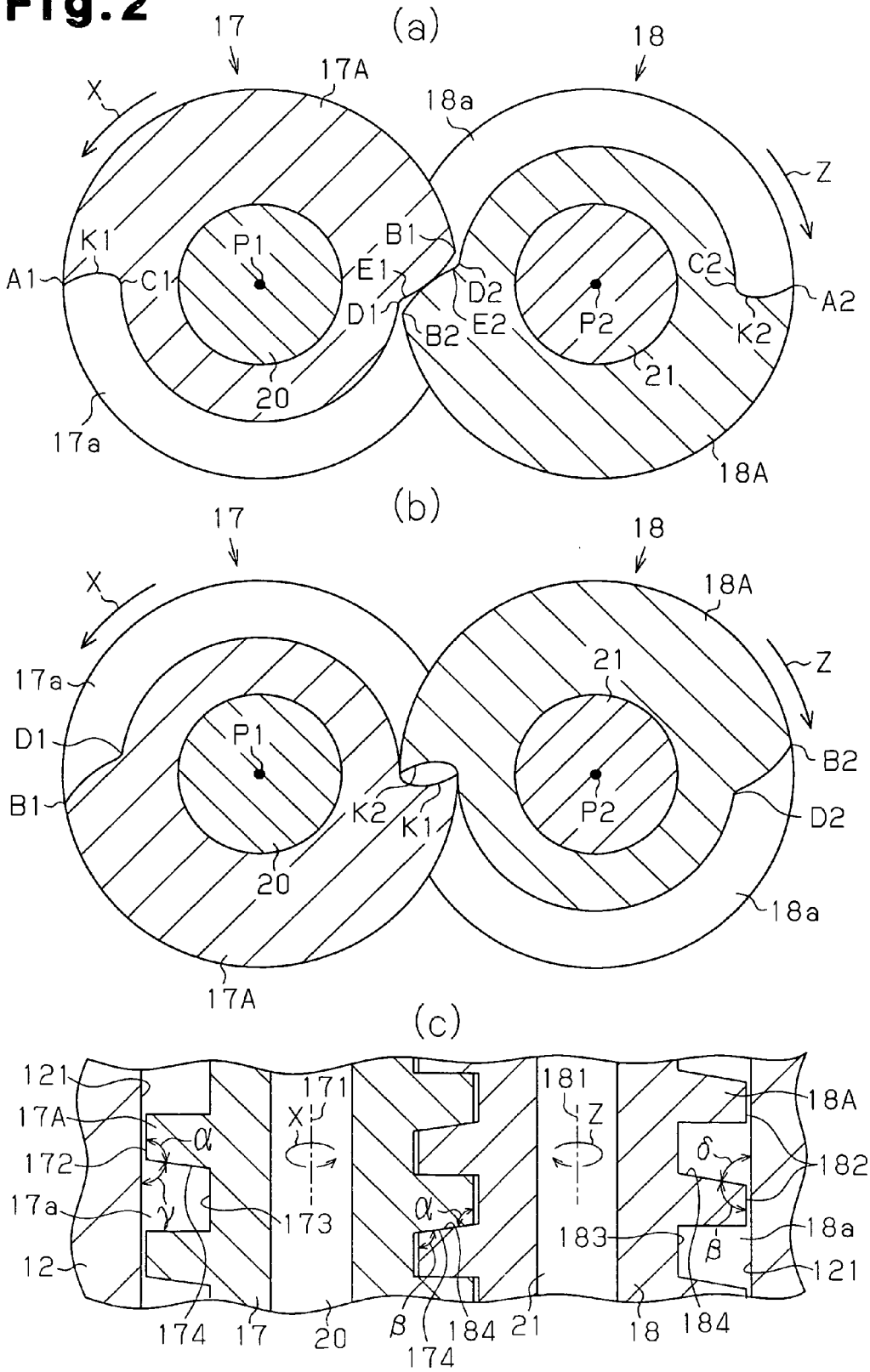
FIG. 2(*a*) is a cross-sectional view taken along line A-A of FIG. 1.

The first screw rotor 17 is rotated in a first rotational direction X and the second screw rotor 18 is rotated in a second rotational direction Z. The first rotational direction X and the second rotational direction Z are opposite to each other. In FIG. 2, the first rotational direction X is a counterclockwise direction and the second rotational direction Z is a clockwise direction.

The first screw rotor 17 and the second screw rotor 18 are screw gears each serving as a fluid transport body. Specifically, a drive tooth 17A is formed in the first screw rotor 17 and a driven tooth 18A is provided in the second screw rotor 18. The first screw rotor 17 includes a drive screw groove 17*a*, which extends between adjacent portions of the drive tooth 17A. The second screw rotor 18 includes a driven screw groove 18*a*, which extends between adjacent portions of the driven tooth 18A. The axial direction of the first screw rotor 17 is to the direction of the first axis 171, which is the rotary axis of the first screw rotor 17. The axial direction of the second screw rotor 18 is to the direction of the second axis 181, which is the rotary axis of the second screw rotor 18.

The first screw rotor 17 and the second screw rotor 18 are received in the rotor housing member 12 in such a manner that the drive tooth 17A and the driven tooth 18A are arranged in the driven screw groove 18*a* and the drive screw groove 17*a*, respectively. In other words, the first screw rotor 17 and the second screw rotor 18 are configured in such a manner as to provide a sealed space between the screw rotors 17, 18. Pump chambers 10 each shaped like a figure eight are defined between each of the first and second screw rotors 17, 18 and an inner circumferential surface 121 of the rotor housing member 12.

The thickness of the drive tooth 17A decreases gradually from the front end (left end as viewed in FIG. 1) of the first screw rotor 17 toward the rear end (right end as viewed in the drawing) and becomes uniform in the vicinity of the rear end. Similarly, the thickness of the driven tooth 18A decreases gradually from the front end (left end as viewed in FIG. 1) of the second screw rotor 18 toward the rear end (right end as viewed in the drawing) and becomes uniform in the vicinity of the rear end. In other words, the interval of the drive tooth 17A, or the width of the drive screw groove 17*a*, decreases gradually from the front end of the first screw rotor 17 toward the rear end and becomes uniform in the vicinity of the rear end. Likewise, the interval of the driven tooth 18A, or the width of the driven screw groove 18*a*, decreases gradually from the front end of the second screw rotor 18 toward the rear end and becomes uniform in the vicinity of the rear end.

A gear housing member 22 having a lidded cylindrical shape is joined with and fixed to the rear end of the rear housing member 14. A rear end 20*a* of the drive shaft 20 and a rear end 21*a* of the driven shaft 21 (right end as viewed in FIG. 1) project into the interior of the gear housing member 22. A pair of timing gears 25 are secured to the rear ends 20*a*, 21*a* in a state engaged with each other. An electric motor 26, which is a drive source, is secured to the gear housing member 22. An output shaft 26*a* of the electric motor 26 is connected to the rear end 20*a* of the drive shaft 20 through a shaft coupling 27.

An inlet port 28 is defined in the center of the front housing member 13. An outlet port 29 is provided in the rear end of the rotor housing member 12. The inlet port 28 and the outlet port 29 each communicate with the pump chambers 10.

As the electric motor 26 runs, the drive shaft 20 is rotated through the output shaft 26*a* and the shaft coupling 27. This causes the driven shaft 21 to rotate in the direction different from the rotational direction of the drive shaft 20 through engagement and connection between the two timing gears 25. In other words, the first screw rotor 17 and the second screw rotor 18 also rotate, drawing gas into the pump chambers 10 through the inlet port 28. The gas is then sent to the outlet port 29 and discharged to the exterior of the pump chambers 10 through the outlet port 29.

The tooth profile of the first screw rotor 17 and that of the second screw rotor 18 will hereafter be explained in detail.

Figure 3:
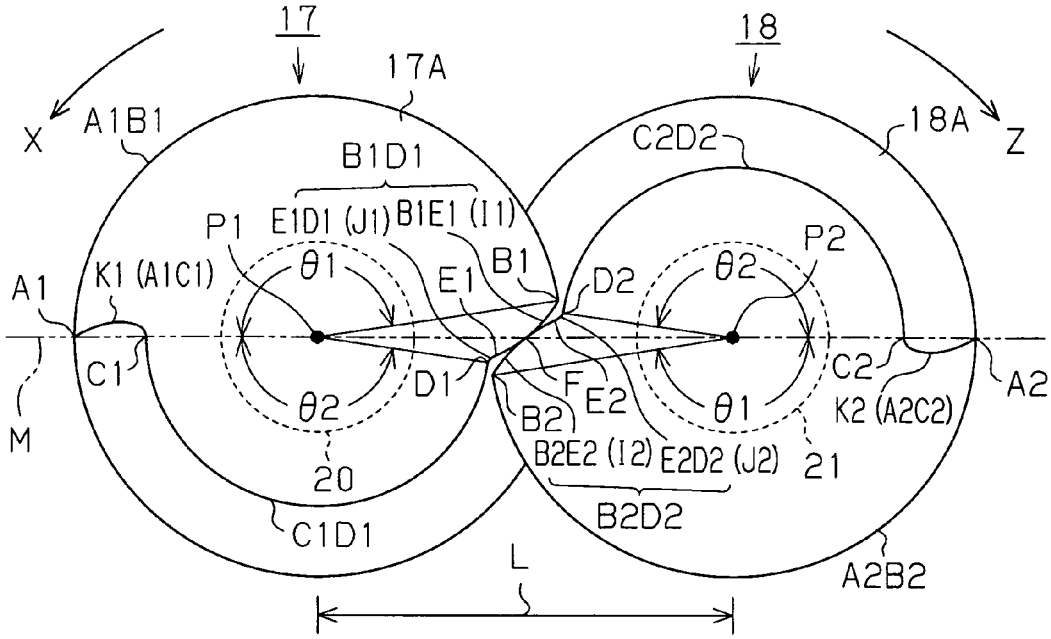
FIG. 3 is a cross-sectional view perpendicular to the axes of the rotors, showing the first screw rotor and the second screw rotor shown in FIG. 2(*a*)

FIG. 3 shows a cross section of the tooth profile of the first screw rotor 17 perpendicular to the rotor axis and that of the second screw rotor 18. The cross section of the tooth profile of the first screw rotor 17 perpendicular to the rotor axis corresponds to a cross-sectional shape of the tooth profile of the first screw rotor 17 on an imaginary plane perpendicular to the axial direction of the first screw rotor 17. The cross section of tooth profile of the second screw rotor 18 perpendicular to the rotor axis is shaped and sized equally with that of the first screw rotor 17.

With reference to FIG. 3, the sign L, which is the distance between the first axis 171 and the second axis 181, refers to an inter-pitch distance L between the drive shaft 20 and the driven shaft 21. As illustrated in the drawing, the distance between a first midpoint P1 on the first axis 171 and a second midpoint P2 on the second axis 181 coincides with the inter-pitch distance L.

The cross section of the tooth profile of the first screw rotor 17 perpendicular to the rotor axis includes a drive tooth top arc A1B1, a drive tooth bottom arc C1D1, a first drive curve A1C1, and a second drive curve B1D1. The drive tooth top arc A1B1 is a first circular arc portion extending from a first end A1 to a second end B1 about the first midpoint P1. The drive tooth bottom arc C1D1 is a second circular arc portion extending from a first end C1 to a second end D1 about the first midpoint P1. The first drive curve A1C1 is a first curved portion that connects the first end A1 of the drive tooth top arc A1B1 to the first end C1 of the drive tooth bottom arc C1D1. The second drive curve B1D1 is a second curved portion that connects the second end B1 of the drive tooth top arc A1B1 to the second end D1 of the drive tooth bottom arc C1D1.

The first midpoint P1 is arranged between the drive tooth top arc A1B1 and the drive tooth bottom arc C1D1. The first end A1 and the first end C1 are located on the same side (left side as viewed in FIG. 2(*a*)) while the second end B1 and the second end D1 are arranged on the opposite side (right side as viewed in the drawing), with respect to the first midpoint P1. The radius of curvature (R2) of the drive tooth bottom arc C1D1 is smaller than the radius of curvature (R1) of the drive tooth top arc A1B1.

With reference to FIG. 3, the cross section of the tooth profile of the second screw rotor 18 perpendicular to the rotor axis includes a driven tooth top arc A2B2, a driven tooth bottom arc C2D2, a first driven curve A2C2, and a second driven curve B2D2. The driven tooth top arc A2B2 is a first circular arc portion extending from a first end A2 to a second end B2 about the second midpoint P2. The driven tooth bottom arc C2D2 is a second circular arc portion extending from a first end C2 to a second end D2 about the second midpoint P2. The first driven curve A2C2 is a first curved portion that connects the first end A2 of the driven tooth top arc A2B2 to the first end C2 of the driven tooth bottom arc C2D2. The second driven curve B2D2 is a second curved portion that connects the second end B2 of the driven tooth top arc A2B2 to the second end D2 of the driven tooth bottom arc C2D2.

The second midpoint P2 is arranged between the driven tooth top arc A2B2 and the driven tooth bottom arc C2D2. The first end A2 and the first end C2 are located on the same side (right side as viewed in FIG. 2(*a*)) while the second end B2 and the second end D2 are arranged on the opposite side (left side as viewed in the drawing) with respect to the second midpoint P2. The radius of curvature (R2) of the driven tooth bottom arc C2D2 is smaller than the radius of curvature (R1) of the driven tooth top arc A2B2.

FIG. 3 illustrates an imaginary straight line M that includes the first midpoint P1 and the second midpoint P2. The first end A1 of the drive tooth top arc A1B1 and the first end A2 of the driven tooth top arc A2B2 are located on the imaginary straight line M. The first drive curve A1C1 is a trochoidal curve (a first drive trochoidal curve) created by the path of the first end A2 of the driven tooth top arc A2B2. The first driven curve A2C2 is a trochoidal curve (a first driven trochoidal curve) created by the path of the first end A1 of the drive tooth stop arc A1B1.

The second drive curve B1D1 is a composite curve formed by a drive involute curve B1E1 and a second drive trochoidal curve E1D1 that extend continuously from each other at a first intersection point E1. The drive involute curve B1E1 extends continuously from the second end B1 of the drive tooth top arc A1B1. The second drive trochoidal curve E1D1 extends continuously from the second end D1 of the drive tooth bottom arc C1D1.

Similarly, the second driven curve B2D2 is a composite curve formed by a driven involute curve B2E2 and a second driven trochoidal curve E2D2 that extend continuously from each other at a second intersection point E2. The driven involute curve B2E2 extends continuously from the second end B2 of the driven tooth top arc A2B2. The second driven trochoidal curve E2D2 extends continuously from the second end D2 of the driven tooth bottom arc C2D2.

Figure 4:
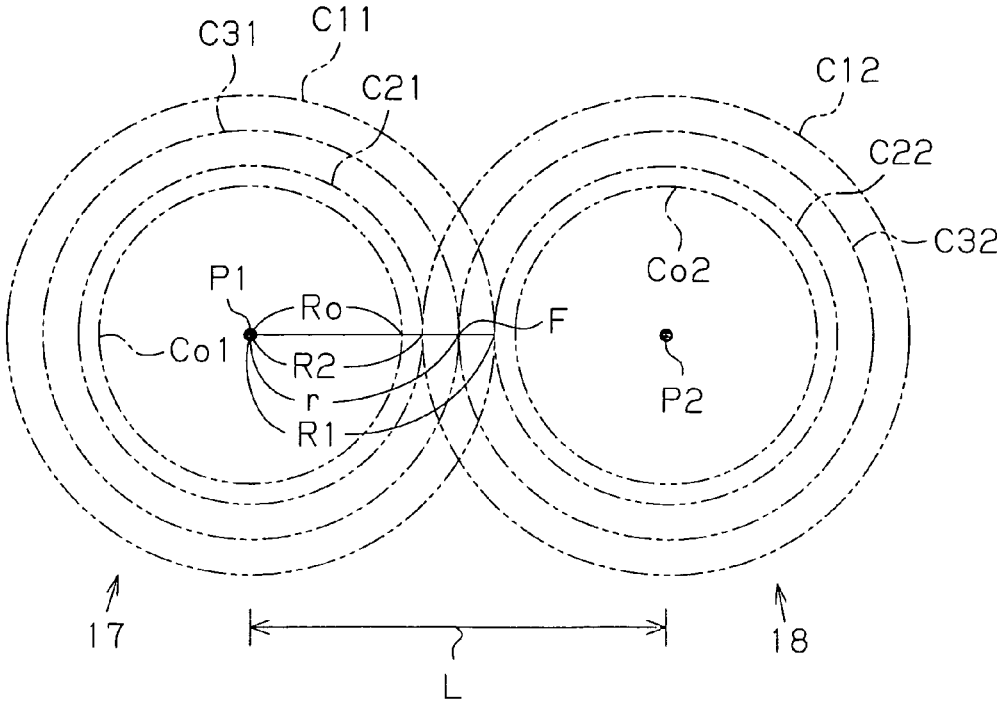
FIG. 4 is a diagrammatic view showing outer circles, inner circles, pitch circles, and midpoints of the first screw rotor and the second screw rotor shown in FIG. 3.

The drive involute curve B1E1 is defined by a first base circle Co1, which is illustrated in FIG. 4. The center of the first base circle Co1 is the first midpoint P1. An involute radius Ro, which is the radius of the first base circle Co1, is smaller than a pitch radius r=L/2, which is a half of the inter-pitch distance L (Ro<r). The driven involute curve B2E2 is defined by a second base circle Co2, which is illustrated in FIG. 4. The center of the second base circle Co2 is the second midpoint P2. The second base circle Co2 has the involute radius Ro with respect to the second midpoint P2.

The second drive trochoidal curve E1D1 is created by the path of the second end B2 of the driven tooth top arc A2B2. The second driven trochoidal curve E2D2 is created by the path of the second end B1 of the drive tooth top arc A1B1.

As illustrated in FIG. 3, the angle of the drive tooth top arc A1B1 about the first midpoint P1 and the angle of the driven tooth top arc A2B2 about the second midpoint P2 are each referred to as a first angle θ1. The angle of the drive tooth bottom arc C1D1 about the first midpoint P1 and the angle of the driven tooth bottom arc C2D2 about the second midpoint P2 are each referred to as a second angle θ2. In the first embodiment, the first angle θ1 of the drive tooth top arc A1B1 is equal to the first angle θ1 of the driven tooth top arc A2B2. Also, the second angle θ2 of the drive tooth bottom arc C1D1 is equal to the second angle θ2 of the driven tooth bottom arc C2D2. In the first embodiment, the first angle θ1 and the second angle θ2 are both less than 180 degrees (θ1<180°, θ2<180°). The first angle θ1 is set equal to the second angle θ2 (θ1=θ2).

As shown in FIG. 2(*c*), the first screw rotor 17 has a drive tooth top surface 172, which is the tooth top surface of the drive tooth 17A, and a drive tooth bottom surface 173, which is the tooth bottom surface of the drive screw groove 17*a*. A cross section of the drive tooth top surface 172 perpendicular to the rotor axis is the drive tooth top arc A1B1. A cross section of the drive tooth bottom surface 173 perpendicular to the rotor axis is the drive tooth bottom arc C1D1. The drive tooth top surface 172 and the drive tooth bottom surface 173 are circumferential surfaces that extend spirally along the first axis 171.

Similarly, the second screw rotor 18 has a driven tooth top surface 182, which is the tooth top surface of the driven tooth 18A, and a driven tooth bottom surface 183, which is the tooth bottom surface of the driven screw groove 18*a*. A cross section of the driven tooth top surface 182 perpendicular to the rotor axis is the driven tooth top arc A2B2. A cross section of the driven tooth bottom surface 183 perpendicular to the rotor axis is the driven tooth bottom arc C2D2. The driven tooth top surface 182 and the driven tooth bottom surface 183 are circumferential surfaces that extend spirally along the second axis 181.

If the first angle θ1 of the first screw rotor 17 is equal to the second angle θ2, the axial dimension of the drive tooth top surface 172 is substantially equal to the axial dimension of the drive tooth bottom surface 173. If the first angle θ1 of the second screw rotor 18 is equal to the second angle θ2, the axial dimension of the driven tooth top surface 182 is substantially equal to the axial dimension of the driven tooth bottom surface 183. The axial dimension of the drive tooth top surface 172 is a dimension measured along the first axis 171 and the axial dimension of the driven tooth top surface 182 is a dimension measured along the second axis 181.

As illustrated in FIG. 2(*c*), the first screw rotor 17 has a drive tooth side surface 174, which is the side surface of the drive tooth 17A, and the second screw rotor 18 has a driven tooth side surface 184, which is the side surface of the driven tooth 18A. The drive tooth side surface 174 is opposed to the driven tooth side surface 184. A cross section of the drive tooth side surface 174 perpendicular to the rotor axis is the second drive curve B1D1. A cross section of the driven tooth side surface 184 perpendicular to the rotor axis is the second driven curve B2D2. The drive tooth side surface 174 is a curved surface that connects the drive tooth top surface 172 to the drive tooth bottom surface 173. The driven tooth side surface 184 is a curved surface that connects the driven tooth top surface 182 to the driven tooth bottom surface 183. The first screw rotor 17 and the second screw rotor 18 rotate in a non-contact manner with each other. However, as the clearance between the first screw rotor 17 and the second screw rotor 18 becomes substantially eliminated, a linear seal portion is formed apparently.

With reference to FIG. 2(*c*), the angle between the drive tooth top surface 172 and the drive tooth side surface 174 is a drive tooth top angle α. The angle between the driven tooth top surface 182 and the driven tooth side surface 184 is a driven tooth top angle β. The angle between the inner circumferential surface 121 of the rotor housing member 12 and the drive tooth side surface 174 is a first clearance angle γ.

The angle between the inner circumferential surface 121 of the rotor housing member 12 and the driven tooth side surface 184 is a second clearance angle δ. The drive tooth top angle α is an obtuse angle (an angle greater than 90° and smaller than 180°) and the first clearance angle γ is an acute angle (an angle less than 90°). The driven tooth top angle β is an obtuse angle and the second clearance angle δ is an acute angle. In the first embodiment, the drive tooth top angle α is equal to the driven tooth top angle β (α=β). The first clearance angle γ is equal to the second clearance angle δ (γ=δ).

A procedure for forming the cross section of the tooth profile of the first screw rotor 17 perpendicular to the rotor axis and the cross section of the tooth profile of the second screw rotor 18 perpendicular to the rotor axis will now be explained.

First, as illustrated in FIG. 4, the first midpoint P1, the second midpoint P2, and the inter-pitch distance L are determined. The circle about the first midpoint P1 with the pitch radius r is referred to as a first pitch circle C31. The circle about the second midpoint P2 with the pitch radius r is referred to as a second pitch circle C32. The pitch radius r is equal to L/2. That is, the first pitch circle C31 and the second pitch circle C32 contact each other at a contact point F, which is located at the midpoint between the first midpoint P1 and the second midpoint P2.

Then, the first outer circle C11 having an outer radius R1 greater than the pitch radius r and the first inner circle C21 with an inner radius R2 smaller than the pitch radius r are determined with respect to the first midpoint P1 (R2≦r≦R1). Similarly, the second outer circle C12 with the outer radius R1 and the second inner circle C22 with the inner radius R2 are determined with respect to the second midpoint P2. The inter-pitch distance L is the sum of the outer radius R1 and the inner radius R2 (L=R1+R2=2r).

Figure 5:
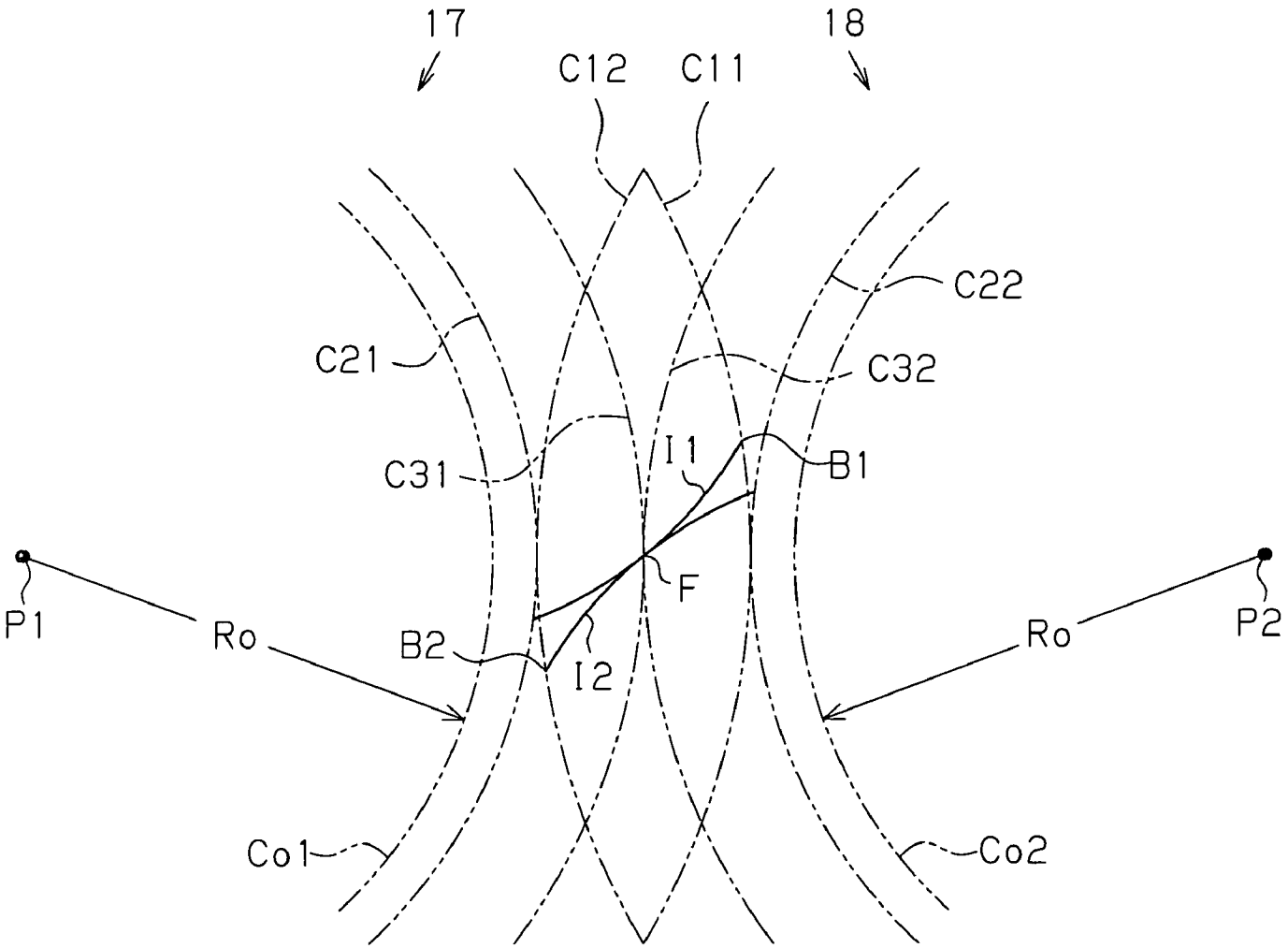
FIG. 5 is an enlarged view of FIG. 4 illustrating involute curves.

Subsequently, with reference to FIG. 5, the first base circle Co1 and the second base circle Co2 are determined. The involute radius Ro is set to a value less than the pitch radius r (Ro<r). Using the first base circle Co1, a created drive involute curve I1 is determined in such a manner that the created drive involute curve I1 includes the contact point F. The intersection point between the created drive involute curve I1 and the first outer circle C11 is the second end B1 of the drive tooth top arc A1B1. Likewise, using the second base circle Co2, a created driven involute curve 12 is determined in such a manner that the created driven involute curve 12 includes the contact point F. The intersection point between the created driven involute curve 12 and the second outer circle C12 is the second end B2 of the driven tooth top arc A2B2.

Figure 6:
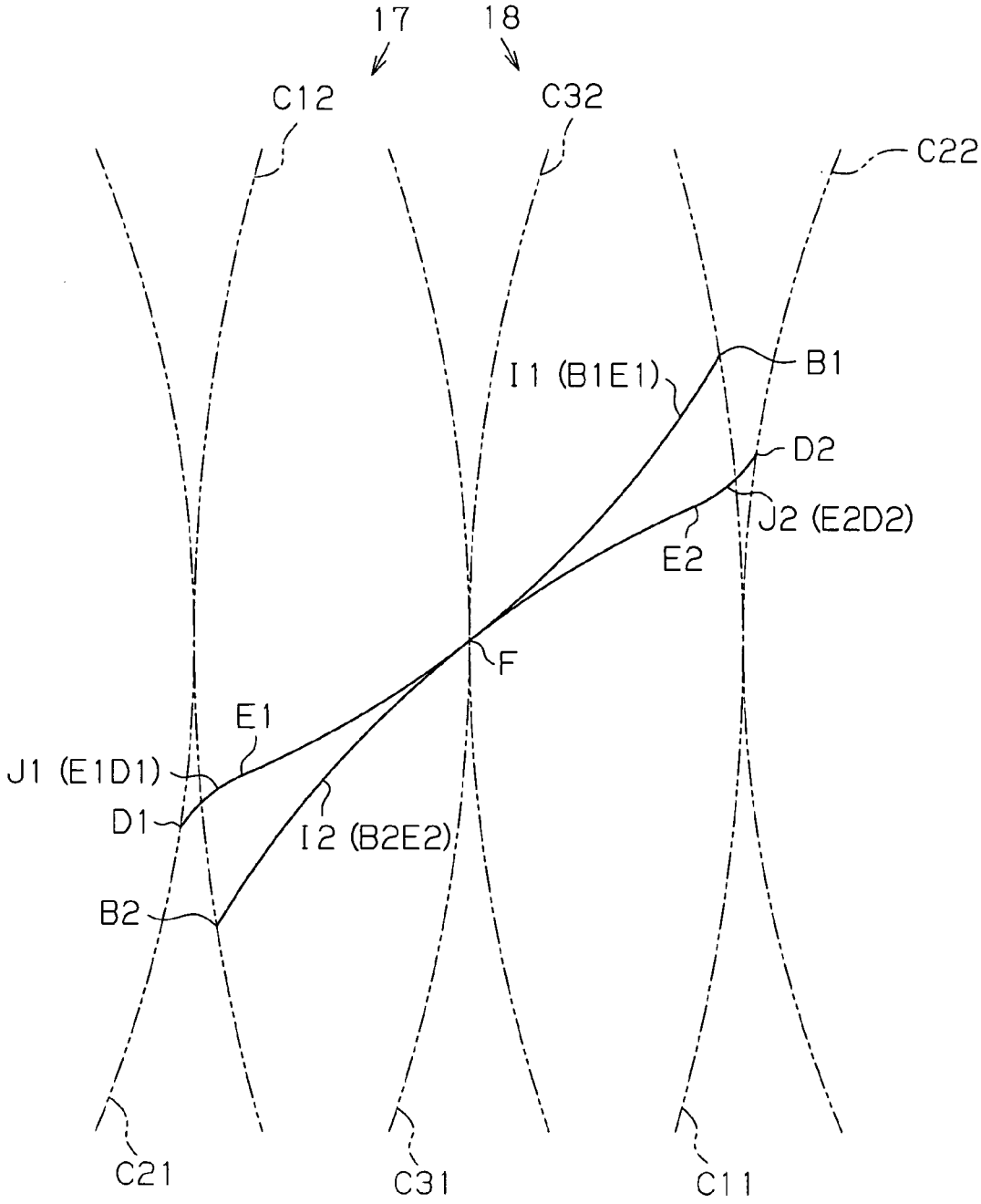
FIG. 6 is an enlarged view of FIG. 5 illustrating involute curves and second trochoidal curves.

Next, as illustrated in FIG. 6, a second created drive trochoidal curve J1 is determined by the path of the second end B2 when the first screw rotor 17 and the second screw rotor 18 are rotated. In other words, a second created drive trochoidal curve J1 is created by revolution of the second screw rotor 18 around the first screw rotor 17 with the second pitch circle C32 held in contact with the first pitch circle C31. The intersection point between the second created drive trochoidal curve J1 and the first inner circle C21 is the second end D1 of the drive tooth bottom arc C1D1. The intersection point between the second created drive trochoidal curve J1 and the created drive involute curve I1 is the first intersection point E1. The second created drive trochoidal curve J1 is connected to the created drive involute curve I1 at the first intersection point E1. The portion of the created drive involute curve I1 between the second end B1 and the first intersection point E1 forms the drive involute curve B1E1. The portion of the second created drive trochoidal curve J1 between the first intersection point E1 and the second end D1 forms the second drive trochoidal curve E1D1. The tangential line of the drive involute curve B1E1 coincides with the tangential line of the second drive trochoidal curve E1D1 at the first intersection point E1. In other words, the first intersection point E1 is a connection point between the drive involute curve B1E1 and the second drive trochoidal curve E1D1.

Similarly, with reference to FIG. 6, a second created driven trochoidal curve J2 is determined by the path of the second end B1 when the first screw rotor 17 and the second screw rotor 18 are rotated. In other words, a second created driven trochoidal curve J2 is created by revolution of the first screw rotor 17 around the second screw rotor 18 with the first pitch circle C31 held in contact with the second pitch circle C32. The intersection point between the second created driven trochoidal curve J2 and the second inner circle C22 is the second end D2 of the driven tooth bottom arc C2D2. The intersection point between the second created driven trochoidal curve J2 and the created driven involute curve 12 is the second intersection point E2. The second created driven trochoidal curve J2 is connected to the created driven involute curve 12 at the second intersection point E2. The portion of the created driven involute curve 12 between the second end B2 and the second intersection point E2 forms the driven involute curve B2E2. The portion of the second created driven trochoidal curve J2 between the second intersection point E2 and the second end D2 forms the second driven trochoidal curve E2D2. The tangential line of the driven involute curve B2E2 coincides with the tangential line of the second driven trochoidal curve E2D2 at the second intersection point E2. In other words, the second intersection point E2 is a connection point between the driven involute curve B2E2 and the second driven trochoidal curve E2D2.

Figure 7:
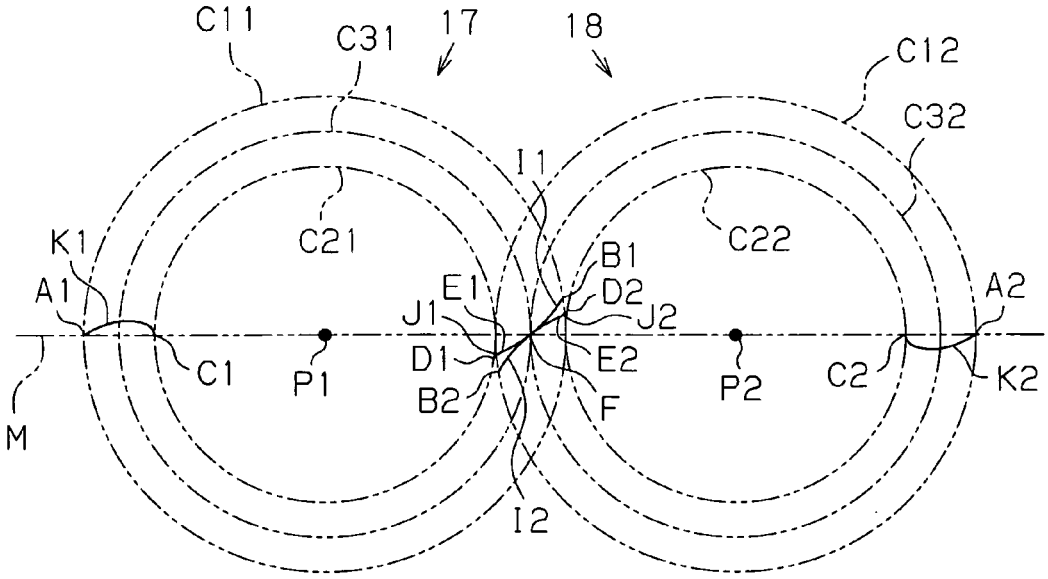
FIG. 7 is a diagrammatic view illustrating first trochoidal curves.

The imaginary straight line M including the first midpoint P1 and the second midpoint P2 is then determined as illustrated in FIG. 7. The intersection point between the imaginary straight line M and the first outer circle C11 outside the range between the first midpoint P1 and the second midpoint P2 is the first end A1 of the drive tooth top arc A1B1. In the same manner, the intersection point between the imaginary straight line M and the second outer circle C12 outside the range between the first midpoint P1 and the second midpoint P2 is the first end A2 of the driven tooth top arc A2B2.

As illustrated in FIG. 7, a first created drive trochoidal curve K1 is determined by the path of the first end A2 of the second screw rotor 18 when the first screw rotor 17 and the second screw rotor 18 are rotated. In other words, the first created drive trochoidal curve K1 is created by revolution of the second screw rotor 18 around the first screw rotor 17 with the second pitch circle C32 held in contact with the first pitch circle C31. The first created drive trochoidal curve K1 includes the first end A1 of the first screw rotor 17. The intersection point between the first created drive trochoidal curve K1 and the first inner circle C21 is the first end C1 of the drive tooth bottom arc C1D1. The portion of the first created drive trochoidal curve K1 between the first end A1 and the first end C1 forms the first drive curve A1C1.

Similarly, with reference to FIG. 7, a first created driven trochoidal curve K2 is determined by the path of the first end A1 of the first screw rotor 17 when the first screw rotor 17 and the second screw rotor 18 are rotated. In other words, the first created driven trochoidal curve K2 is created by revolution of the first screw rotor 17 around the second screw rotor 18 with the first pitch circle C31 held in contact with the second pitch circle C32. The first created driven trochoidal curve K2 includes the first end A2 of the second screw rotor 18. The intersection point between the first created driven trochoidal curve K2 and the second inner circle C22 is the first end C2 of the driven tooth bottom arc C2D2. The portion of the first created driven trochoidal curve K2 between the first end A2 and the first end C2 forms the first driven curve A2C2.

The portion of the first outer circle C11 between the first end A1 and the second end B1 forms the drive tooth top arc A1B1. The drive tooth top arc A1B1 is determined in such a manner that an acute angle is formed between the drive tooth top arc A1B1 and the first drive curve A1C1. The portion of the first inner circle C21 between the first end C1 and the second end D1 forms the drive tooth bottom arc C1D1. The drive tooth bottom arc C1D1 is determined in such a manner that the first midpoint P1 is provided between the drive tooth top arc A1B1 and the drive tooth bottom arc C1D1. The radius of curvature of the drive tooth top arc A1B1 is the outer radius R1 and the radius of curvature of the drive tooth bottom arc C1D1 is the inner radius R2.

In the same manner, the portion of the second outer circle C12 between the first end A2 and the second end B2 forms the driven tooth top arc A2B2. The driven tooth top arc A2B2 is determined in such a manner that an acute angle is formed between the driven tooth top arc A2B2 and the first driven curve A2C2. The portion of the second inner circle C22 between the first end C2 and the second end D2 forms the driven tooth bottom arc C2D2. The driven tooth bottom arc C2D2 is determined in such a manner that the second midpoint P2 is provided between the driven tooth top arc A2B2 and the driven tooth bottom arc C2D2.

In this manner, the procedure for forming the cross sections of the tooth profiles of the first screw rotor 17 and the second screw rotor 18 perpendicular to the respective rotor axes is accomplished.

Figure 8:
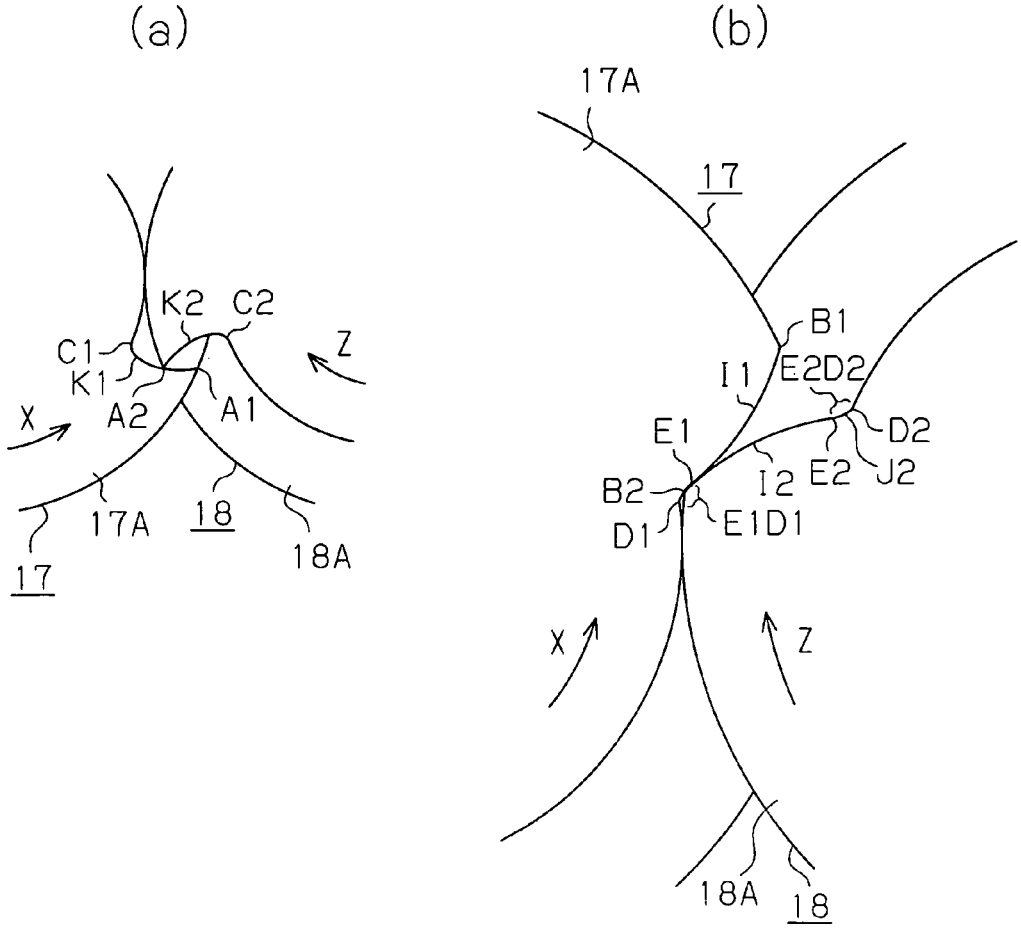
FIG. 8(*a*) is a diagrammatic view showing the first curved portions that are engaged with each other.

As the first screw rotor 17 of the screw pump 11 continuously rotates in the first rotational direction X and the second screw rotor 18 continuously rotates in the second rotational direction Z, the first end A2 of the second screw rotor 18 moves along the first drive curve A1C1, as illustrated in FIG. 8(*a*). The first end A1 of the first screw rotor 17 then moves along the first driven curve A2C2.

As the first screw rotor 17 and the second screw rotor 18 continuously rotate, the second end B1 of the first screw rotor 17 moves along the second driven trochoidal curve E2D2. The drive involute curve B1E1 then becomes engaged with the driven involute curve B2E2. Afterwards, with reference to FIG. 8(*b*), the second end B2 of the second screw rotor 18 moves along the second drive trochoidal curve E1D1.

Figure 9:
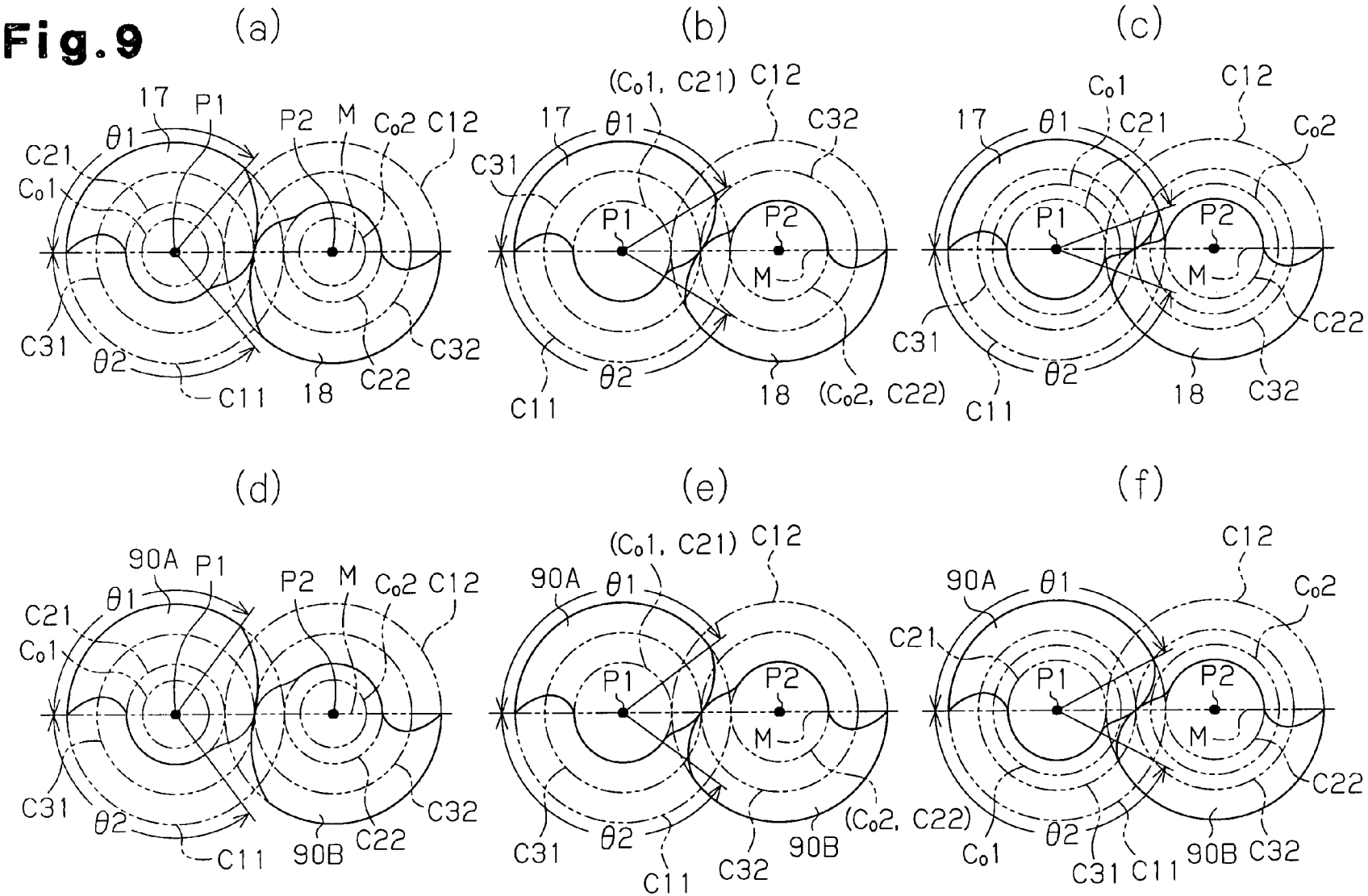
FIGS. 9(*a*), 9(*b*), and 9(*c*) are cross-sectional views perpendicular to the axes of the rotors, showing examples of a tooth profile of a first screw rotor and a tooth profile of a second screw rotor.
Figure 11:
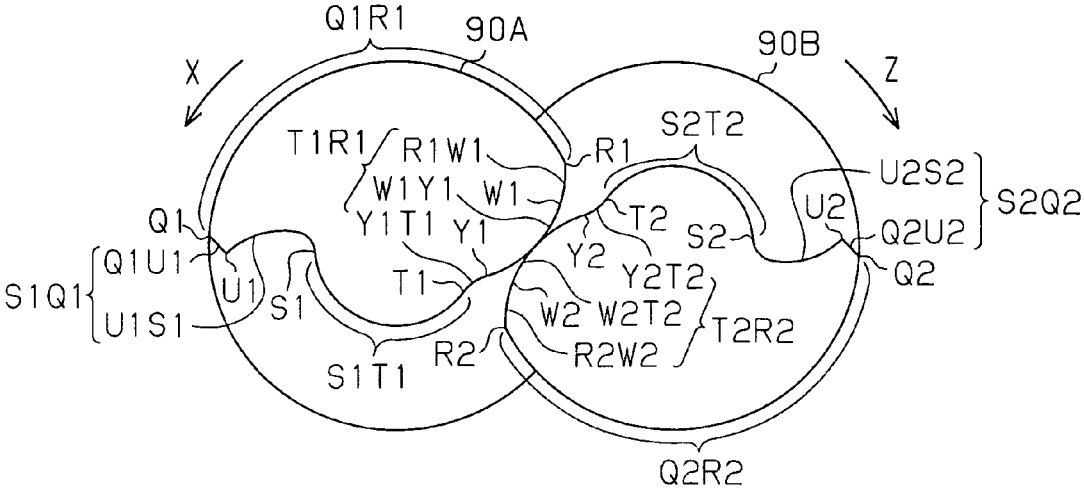
Fig.11 (Prior Art)
FIG. 11 is a cross-sectional view showing a pair of conventional screw rotors as viewed perpendicularly to the axes of the rotors.

FIG. 9(*a*), FIG. 9(*b*), and FIG. 9(*c*) show a first example, a second example, and a third example, respectively, of the tooth profiles of the first screw rotor 17 and the second screw rotor 18 according to the present invention. FIG. 9(*d*), FIG. 9(*e*), and FIG. 9(*f*) show a first comparative example, a second comparative example, and a third comparative example, respectively, of the tooth profiles of the first and second conventional screw rotors 90A, 90B, which are shown in FIG. 11. Commonly in FIGS. 9(*a*) to 9(*f*), the pitch radius r, the outer radius R1, and the inner radius R2 are set to 40 mm, 55.5 mm, and 24.5 mm, respectively.

In FIGS. 9(*a*) and 9(*d*), the involute radius Ro is smaller than the inner radius R2 (Ro<R2), and Ro is set to 16.75 mm. In FIGS. 9(*b*) and 9(*e*), the involute radius Ro is equal to the inner radius R2 (Ro=R2), and Ro is set to 24.5 mm. In FIGS. 9(*c*) and 9(*f*), the involute radius Ro is greater than the inner radius R2 and smaller than the pitch radius r (R2<Ro<r), and Ro is set to 32.25 mm.

In the first example shown in FIG. 9(*a*), in which Ro is 16.75 mm, the equation: $\theta 1=\theta 2=130.67°$ is satisfied. In the first comparative example shown in FIG. 9(*d*), in which Ro is 16.75 mm, the equation: $\theta 1=\theta 2=126.9°$ is satisfied.

In the second example shown in FIG. 9(*b*), in which Ro is 24.5 mm, the equation: $\theta 1=\theta 2=149.43°$ is satisfied. In the second comparative example shown in FIG. 9(*e*), in which Ro is 24.5 mm, the equation: $\theta 1=\theta 2=143.85°$ is satisfied.

In the third example shown in FIG. 9(*c*), in which Ro is 32.25 mm, the equation: $\theta 1=\theta 2=160°$ is satisfied. In the third comparative example shown in FIG. 9(*f*), in which Ro is 32.25 mm, the equation: $\theta 1=\theta 2=152.68°$ is satisfied.

As is clear from comparison between the first example of FIG. 9(*a*) and the first comparative example of FIG. 9(*d*), when the involute radius Ro is smaller than the inner radius R2 (Ro<R2), the values θ1 and θ2 of the first screw rotor 17 and the second screw rotor 18 are greater than the values θ1 and θ2 of the first and second conventional screw rotors 90A, 90B.

As is clear from comparison between the second example of FIG. 9(*b*) and the second comparative example of FIG. 9(*e*), when the involute radius Ro is equal to the inner radius R2 (Ro=R2), the values θ1 and θ2 of the first screw rotor 17 and the second screw rotor 18 are greater than the values θ1 and θ2 of the first and second conventional screw rotors 90A, 90B.

As is clear from comparison between the third example of FIG. 9(*c*) and the third comparative example of FIG. 9(*f*), when the involute radius Ro is greater than the inner radius R2 and smaller than the pitch radius r (R2<Ro<r), the values θ1 and θ2 of the first screw rotor 17 and the second screw rotor 18 are greater than the values θ1 and θ2 of the first and second conventional screw rotors 90A, 90B.

In other words, when the involute radius Ro is smaller than the pitch radius r (Ro<r), the values θ1 and θ2 of the first and second screw rotors 17, 18 are greater than the values θ1 and θ2 of the first and second conventional screw rotors 90A, 90B. When the involute radius Ro is greater than or equal to the pitch radius r (r≦Ro), the drive involute curve B1E1 is not engaged with the driven involute curve B2E2.

The first embodiment has the following advantages.

(1) The second drive curve B1D1 is the composite curve formed by the drive involute curve B1E1 and the second drive trochoidal curve E1D1. The second driven curve B2D2 is the composite curve formed by the driven involute curve B2E2 and the second driven trochoidal curve E2D2. In contrast, a second conventional drive curve T1R1, which is illustrated in FIG. 11, is a composite curve formed by an outer circular arc R1W1, an involute curve W1Y1, and an inner circular arc Y1T1. As a result, in the first embodiment, the length of the second drive curve B1D1 and the length of the second driven curve B2D2 are decreased compared to the conventional case. This increases the circumferential dimension of the drive tooth top arc A1B1, or the first angle θ1, and the circumferential dimension of the drive tooth bottom arc C1D1, or the second angle θ2. Also, the circumferential dimension of the driven tooth top arc A2B2, or the first angle θ1, and the circumferential dimension of the driven tooth bottom arc C2D2, or the second angle θ2, are increased.

As the circumferential dimension of the drive tooth top arc A1B1 increases, the axial dimension of the drive tooth top surface 172 increases. This increases the seal length between the drive tooth top surface 172 and the inner circumferential surface 121 of the rotor housing member 12. Thus, leakage of fluid between adjacent ones of the pump chambers 10 is effectively suppressed. Further, as the circumferential dimension of the driven tooth top arc A2B2 increases, the axial dimension of the driven tooth top surface 182 increases. The seal length between the driven tooth top surface 182 and the inner circumferential surface 121 of the rotor housing member 12 is thus increased. This effectively suppresses the leakage of the fluid between adjacent ones of the pump chambers 10.

(2) As the circumferential dimension of the drive tooth bottom arc C1D1 increases, the axial dimension of the drive tooth bottom surface 173 increases. This facilitates machining of the drive screw groove 17*a*. Also, as the circumferential dimension of the driven tooth bottom arc C2D2 increases, the axial dimension of the driven tooth bottom surface 183 increases. This facilitates machining of the driven screw groove 18*a*.

(3) The drive tooth side surface 174 of the first screw rotor 17 is opposed to the driven tooth side surface 184 of the second screw rotor 18. The angle between the drive tooth side surface 174 and the drive tooth top surface 172 is the drive tooth top angle α. The angle between the driven tooth side surface 184 and the driven tooth top surface 182 is the driven tooth top angle β. The drive tooth side surface 174 of the first screw rotor 17 is created by the second driven curve B2D2, which is the composite curve formed by the driven involute curve B2E2 and the second driven trochoidal curve E2D2. In contrast, the drive tooth side surface of the first conventional screw rotor 90A, which is shown in FIG. 11, is created by the second curve T2R2, which is the composite curve formed by the outer circular arc R2W2, the involute curve W2Y2, and the inner circular arc Y2T2. Thus, in the first embodiment, the drive tooth top angle α becomes smaller than that of the conventional case. In other words, in this embodiment, the first clearance angle γ becomes greater than that of the conventional case. That is, the first clearance angle γ becomes wider than that of the conventional case. As a result, in this embodiment, foreign objects such as a reaction product contained in the fluid (the gas) transported through operation of the screw pump 11 are prevented from entering the gap between the inner circumferential surface 121 of the rotor housing member 12 and the drive tooth top surface 172.

Similarly, the driven tooth side surface 184 of the second screw rotor 18 is created by the second drive curve B1D1, which is the composite curve formed by the drive involute curve B1E1 and the second drive trochoidal curve E1D1. In contrast, the driven tooth side surface of the second conventional screw rotor 90B, which is shown in FIG. 11, is created by the second curve T1R1, which is the composite curve formed by the outer circular arc R1W1, the involute curve W1Y1, and the inner circular arc Y1T1. Thus, in the first embodiment, the driven tooth top angle δ becomes smaller than that of the conventional case and the second clearance angle δ becomes greater than that of the conventional case. That is, the second clearance angle δ becomes wider than that of the conventional case. As a result, in this embodiment, the foreign objects contained in the fluid that is being transported are prevented from entering the gap between the inner circumferential surface 121 of the rotor housing member 12 and the driven tooth top surface 182.

(4) The second driven curve B2D2, which is the composite curve formed by the driven involute curve B2E2 and the second driven trochoidal curve E2D2, forms the drive tooth side surface 174. The second drive curve B1D1, which is the composite curve formed by the drive involute curve B1E1 and the second drive trochoidal curve E1D1, forms the driven tooth side surface 184. This enlarges the clearance around the linear seal portion created between the drive tooth side surface 174 and the driven tooth side surface 184 in the vicinity of the drive tooth bottom surface 173 and the vicinity of the driven tooth bottom surface 183. Thus, the screw pump 11 is further effectively prevented from catching foreign objects.

For example, the involute curve W1Y1 illustrated in FIG. 11 is indirectly connected to the tooth top arc Q1R1 through the outer circular arc R1W1. This arrangement causes the foreign objects to be easily collected in an area from the clearance near the tooth bottom surface to the seal portion between the tooth top surface and the tooth bottom surface. The foreign obstacles are thus easily caught. However, in the first embodiment, this problem is solved.

The first embodiment may be modified as follows.

The thickness (the axial dimension) of the drive tooth 17A may be uniform from the front end to the rear end of the first screw rotor 17, instead of decreasing from the front end to the rear end of the first screw rotor 17. Similarly, the thickness of the driven tooth 18A may be uniform from the front end to the rear end of the second screw rotor 18.

The number of the drive teeth 17A of the first screw rotor 17 and the number of the driven teeth 18A of the second screw rotor 18 are not restricted to one but may be two.

Figure 10:
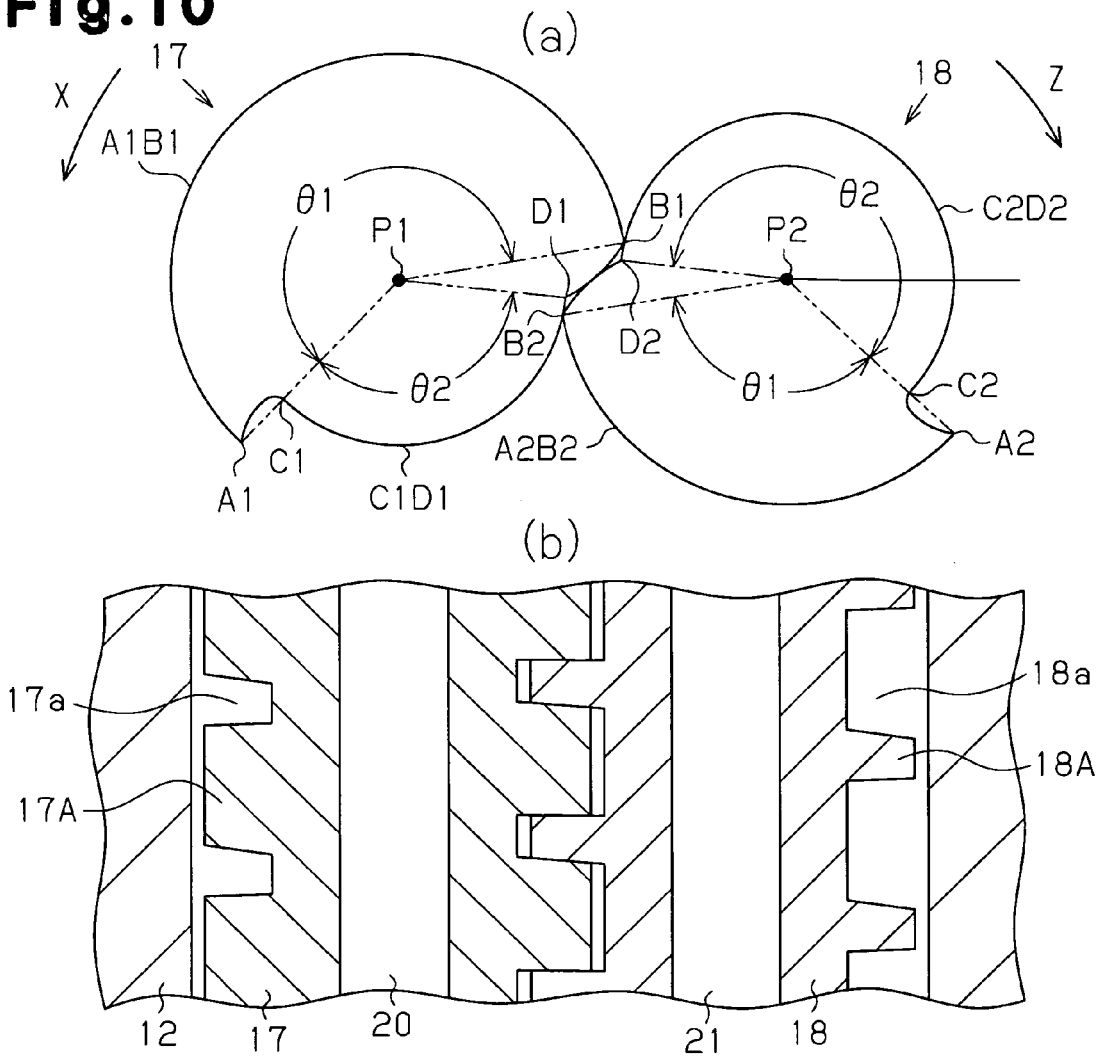
FIG. 10(*a*) is a cross-sectional view showing a tooth profile of a first screw rotor and a tooth profile of a second screw rotor according to a second embodiment of the present invention.

The first angle θ1 and the second angle θ2 may be altered as needed. For example, as in a second embodiment shown in FIG. 10(*a*), the first angle θ1 of the first screw rotor 17 may be greater than the second angle θ2. That is, the first angle θ1 may be set to a value greater than 180° while the second angle θ2 is set to a value smaller than 180°. The circumferential dimension of the drive tooth top arc A1B1 is greater than the circumferential dimension of the driven tooth bottom arc C2D2. The first angle θ1 of the second screw rotor 18 is set to a value smaller than the second angle θ2. In other words, the circumferential dimension of the driven tooth top arc A2B2 is set to a value smaller than the circumferential dimension of the driven tooth bottom arc C2D2. In this case, with reference to FIG. 10(*b*), the axial dimension of the drive tooth 17A is greater than the axial dimension of the driven tooth 18A. The width (the axial dimension) of the drive screw groove 17*a* is smaller than the width of the driven screw groove 18*a*.

The invention claimed is:

1. A screw pump comprising:

a housing; and a first screw rotor and a second screw rotor received in the housing, wherein the first screw rotor and the second screw rotor rotate in a direction in which the first and second screw rotors become engaged with each other, a fluid being drawn into the housing and then discharged to the exterior through rotation of the first screw rotor and the second screw rotor, wherein a cross section of a tooth profile of the first screw rotor and a cross section of a tooth profile of the second screw rotor perpendicular to the respective rotor axes each include a first circular arc portion, a second circular arc portion, a first curved portion, and a second curved portion, the first circular arc portion and the second circular arc portion each having a first end and a second end, a radius of curvature of the second circular arc portion being smaller than a radius of curvature of the first circular arc portion, the first curved portion connecting the first end of the first circular arc portion to the first end of the second circular arc portion, the second curved portion connecting the second end of the first circular arc portion to the second end of the second circular arc portion, wherein the first curved portion of the first screw rotor is a first trochoidal curve created by the first end of the first circular arc portion of the second screw rotor, wherein the second curved portion of the first screw rotor includes an involute curve and a second trochoidal curve that extend continuously from each other, the involute curve extending continuously from the second end of the first circular arc portion of the first screw rotor, the second trochoidal curve being created by the second end of the first circular arc portion of the second screw rotor, wherein the first curved portion of the second screw rotor is a first trochoidal curve created by the first end of the first circular arc portion of the first screw rotor, and wherein the second curved portion of the second screw rotor includes an involute curve and a second trochoidal curve that extend continuously from each other, the involute curve extending continuously from the second end of the first circular arc portion of the second screw rotor, the second trochoidal curve being created by the second end of the first circular arc portion of the first screw rotor.

2. The screw pump according to claim 1, wherein the rotary axis of the first screw rotor is referred to as a first axis, and the rotary axis of the second screw rotor is referred to as a second axis, wherein an angle of the first circular arc portion of the first screw rotor with respect to the first axis, an angle of the second circular arc portion of the first screw rotor with respect to the first axis, an angle of the first circular arc portion of the second screw rotor with respect to the second axis, and an angle of the second circular arc portion of the second screw rotor with respect to the second axis are all equal.

3. A screw rotor of a screw pump, the screw rotor being one of a first screw rotor and a second screw rotor, the first screw rotor and the second screw rotor being accommodated in a housing of the screw pump, the first screw rotor and the second screw rotor rotating in a direction in which the first and second screw rotors become engaged with each other, thereby drawing a fluid into the housing and then discharging the fluid to the exterior of the housing, wherein a cross section of a tooth profile of the first screw rotor and a cross section of a tooth profile of the second screw rotor perpendicular to the respective rotor axes each include a first circular arc portion, a second circular arc portion, a first curved portion, and a second curved portion, the first circular arc portion and the second circular arc portion each having a first end and a second end, a radius of curvature of the second circular arc portion being smaller than a radius of curvature of the first circular arc portion, the first curved portion connecting the first end of the first circular arc portion to the first end of the second circular arc portion, the second curved portion connecting the second end of the first circular arc portion to the second end of the second circular arc portion, wherein the first curved portion of the first screw rotor is a first trochoidal curve created by the first end of the first circular arc portion of the second screw rotor, wherein the second curved portion of the first screw rotor includes an involute curve and a second trochoidal curve that extend continuously from each other, the involute curve extending continuously from the second end of the first circular arc portion of the first screw rotor, the second trochoidal curve being created by the second end of the first circular arc portion of the second screw rotor, wherein the first curved portion of the second screw rotor is a first trochoidal curve created by the first end of the first circular arc portion of the first screw rotor, and wherein the second curved portion of the second screw rotor includes an involute curve and a second trochoidal curve that extend continuously from each other, the involute curve extending continuously from the second end of the first circular arc portion of the second screw rotor, the second trochoidal curve being created by the second end of the first circular arc portion of the first screw rotor.

* * * * *